US007311459B2

(12) United States Patent
Ikai et al.

(10) Patent No.: US 7,311,459 B2
(45) Date of Patent: Dec. 25, 2007

(54) FOLLOWER FOR NON-AQUEOUS BALL POINT PEN AND NON-AQUEOUS BALL POINT PEN

(75) Inventors: Takayuki Ikai, Yokohama (JP); Shuji Ichikawa, Yokohama (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/552,284

(22) PCT Filed: Apr. 16, 2004

(86) PCT No.: PCT/JP2004/005482

§ 371 (c)(1),
(2), (4) Date: Oct. 4, 2005

(87) PCT Pub. No.: WO2004/091931

PCT Pub. Date: Oct. 28, 2004

(65) Prior Publication Data

US 2007/0020031 A1 Jan. 25, 2007

(30) Foreign Application Priority Data

Apr. 17, 2003 (JP) ..... 2003-113346

(51) Int. Cl.
*B43K 7/08* (2006.01)

(52) U.S. Cl. ..... 401/142; 401/141

(58) Field of Classification Search ..... 401/141, 401/142

See application file for complete search history.

(56) References Cited

U.S. PATENT DOCUMENTS 6,012,864 A * 1/2000 Asami ..... 401/142
6,200,053 B1 * 3/2001 Asami et al. ..... 401/142

FOREIGN PATENT DOCUMENTS

| | | |
|---|---|---|
| JP | 6-33024 | 5/1994 |
| JP | 6-336584 | 12/1994 |
| JP | 7-216285 | 8/1995 |
| JP | 7-266780 | 10/1995 |
| JP | 8-183286 | 7/1996 |
| JP | 9-76687 | 3/1997 |
| JP | 2859068 | 12/1998 |
| JP | 11-42882 | 2/1999 |
| JP | 11-129674 | 5/1999 |
| JP | 11-245578 | 9/1999 |
| JP | 3016749 | 12/1999 |
| JP | 2000-177288 | 6/2000 |
| JP | 2001-63272 | 3/2001 |
| JP | 2002-309148 | 10/2002 |

* cited by examiner

*Primary Examiner*—David J. Walczak
(74) *Attorney, Agent, or Firm*—Foley & Lardner LLP

(57) ABSTRACT

A follower for a nonaqueous ballpoint pen, comprising at least one poly-α-olefin which is a synthetic oil having a viscosity of 200 mPa·s or more at 40° C., wherein the total amount of poly-α-olefins is 80 mass % or more of all components, the viscosity at 40° C. is from 1,000 to 30,000 mPa·s, and the shear-thinning index at a shear rate of 1 to 10/s is 0.95 or more. A follower for a nonaqueous ballpoint pen can be used also for a nonaqueous ballpoint pen using a solvent having a high vapor pressure and causes no problem even when the follower is mounted in an ink reservoir tube with strong tube resistance having an inner diameter of 2.8 mm or less.

17 Claims, 1 Drawing Sheet

FOLLOWER FOR NON-AQUEOUS BALL POINT PEN AND NON-AQUEOUS BALL POINT PEN

TECHNICAL FIELD

The present invention relates to a follower which is used at the tail end part of a nonaqueous ballpoint pen ink housed in an ink reservoir tube, and a nonaqueous ballpoint pen using the same.

BACKGROUND ART

Conventionally, a grease is used as the follower for an oily ballpoint pen, but this is disadvantageous in that, for example, the grease not only has insufficient quality and causes separation or becomes compatible with ink during storage at a high temperature or for a long period of time, but also due to its opacity, can be hardly distinguished from ink and gives the impression that writing cannot be performed any more even though some ink remains.

A conventional oily ballpoint pen in general comprises a solvent portion in which 90% or more is occupied by 2-phenoxyethanol and/or benzyl alcohol, and since the vapor pressure of such a solvent at 20° C. is 0.2 mmHg or less, the evaporation of the solvent from the rear end part of a pen is less of a problem.

In addition, the ink viscosity at 25° C. is from 3,000 to 20,000 mPa·s, and therefore splashing due to impact rarely occurs.

Accordingly, a conventional oily ballpoint pen has, as long as the inner diameter of the ink reservoir tube is 2.8 mm or less, a strong tube resistance and by the effect of surface tension, causes no leakage of the ink from the rear end part even when the pen is left standing with the penpoint upward or sideward, and a follower is not necessarily required.

If a follower is used for an oily ballpoint pen in which the inner diameter of the ink reservoir tube is 2.8 mm or less, the tube resistance increases and starving or splitting readily occurs due to following failure of the follower at low temperatures or during high-speed writing. A follower with good flowability is therefore in demand.

However, if a follower with good flowability is used, the follower is readily splashed due to impact on dropping.

Furthermore, when the pen is left standing with the penpoint upward, depending on the standing environment, a problem of reversal between the ink and the follower is liable to occur, or a phenomenon (dripping) wherein the follower extends in aging to wet the wall surface of the ink reservoir tube and in combination with the effect of gravity, drips down the wall surface of the ink reservoir tube, resulting in a decrease in the amount of the follower at the rear end part of ink, is liable to occur.

In the case where pseudoplasticity is imparted to increase the apparent viscosity during standing and decrease the flowability so as to decrease reversal or dripping of the follower when the pen is left standing with the penpoint upward, the amount of the follower attached to the wall surface increases at the time of consuming of the ink and the amount of the follower present in the rear end part of ink decreases considerably as the ink is consumed. As a result, in an extreme case, the follower is lost from the rear end part.

Also, as described above, since the apparent viscosity in the low shear rate region is high, starving or splitting due to following failure of the follower is readily caused at low temperatures or at high-speed writing.

In addition, when an air bubble is present or created inside the refill, the air bubble cannot be expelled from the rear end part of the follower because the apparent viscosity in the low shear rate region is high, and this gives rise to a problem such as starving or splitting. Furthermore, if the air bubble grows or the pen body is left standing at a high temperature, the follower may leak out from the rear end part of the ink reservoir tube due to the increase in the volume of the air bubble.

That is, when a follower is used for an oily ballpoint pen in which the inner diameter of the ink reservoir tube is 2.8 mm or less, it is difficult to achieve a balance among the followability of follower at low temperatures or during high-speed writing, the resistance on dropping, the reversing property in standing upward and the dripping property.

Also, problems incurred by the decrease in the follower amount at the rear end part of ink along with consumption of the ink, or by the remaining of an air bubble must be overcome.

The inner diameter of the ink reservoir tube of a ballpoint pen is set in many cases by taking account of various balances such as ink discharge amount at the ballpoint pen tip, writing distance, good or bad looking from the filled-ink length in appearance, and design of the pen, and in the case where a follower is required, a follower having physical properties appropriate for the inner diameter set of the ink reservoir tube is necessary.

On the other hand, as for the aqueous ballpoint pen, followers used in an aqueous ballpoint pen where ink is directly housed in an ink reservoir tube are disclosed in Japanese Examined Patent Publication (Kokoku) No. 6-33024, Japanese Patent Nos. 2,859,068 and 3,016,749, and Japanese Unexamined Patent Publication (Kokai) Nos. 7-216285, 8-183286, 9-76687, 11-42882, 2001-63272, 6-336584, 2000-177288 and 7-266780. These followers have a function of preventing volatilization of water from the rear end part, leakage of ink caused when the pen is left standing upward or sideward, and splashing of ink due to impact.

The disclosed followers for use in an aqueous ballpoint pen are surely usable as a follower of an aqueous ballpoint pen.

Also, the disclosed followers are supposed to be filled in an ink reservoir tube having an inner diameter of 2.8 mm or more and probably for this reason, a gelling agent for imparting a shear-thinning property is used as an essential component in most of these followers.

In the case of using an ink reservoir tube with strong tube resistance having an inner diameter of 2.8 mm or less, a problem arises by the effect of a gelling agent, that is, starving or splitting readily occurs due to following failure of the follower at low temperatures or during high-speed writing, the amount of the follower attached to the wall surface increases at the time of consuming of the ink, or the amount of the follower present in the rear end part of ink seriously decreases as the ink is consumed.

The present inventors have developed a nonaqueous ballpoint pen using, unlike conventional oily ballpoint pens, a solvent having a high vapor pressure, but found that a follower is necessary for the nonaqueous ballpoint pen ink using such a solvent having a high vapor pressure.

Also, for the above-described reasons, a follower having physical properties appropriate for an ink reservoir tube having an inner diameter of 2.8 mm or less is required.

Accordingly, the above-described follower for an aqueous ballpoint pen, which has been heretofore disclosed and is commonly used, was used for the nonaqueous ballpoint pen using a solvent having a high vapor pressure, which is currently under development. As a result, the follower could not be used as-is.

Under these circumstances, an object of the present invention is to solve those problems and provide a follower for a nonaqueous ballpoint pen, which can be used also for a nonaqueous ballpoint pen using a solvent having a high vapor pressure, is stable without undergoing separation even during storage at a high temperature or for a long period of time, prevents volatilization of ink by sealing the ink from the outer air, causes no problem in the followability of the follower at low temperatures or during high-speed writing even when the follower is mounted in an ink reservoir tube with strong tube resistance having an inner diameter of 2.8 mm or less, ensures resistance against impact on dropping, has low susceptibility to reversal between the ink and the follower due to a difference in gravity when the pen is left standing with the penpoint upward, is resistant to the phenomenon (dripping) wherein the follower drips in aging down the wall surface of the ink reservoir tube, and is less reduced in amount of the follower at the rear end part of ink as the ink is consumed. The object of the present invention also includes providing a nonaqueous ballpoint pen containing such a follower.

DISCLOSURE OF THE INVENTION

As a result of intensive investigations to attain the above-described object, the present inventors have found that these problems can be overcome by a follower for a nonaqueous ballpoint pen, which is characterized by the following points. The present invention has been accomplished based on this finding.

[1] A follower for a nonaqueous ballpoint pen, comprising at least one poly-α-olefin which is a synthetic oil having a viscosity of 200 mPa·s or more at 40° C., wherein the total amount of poly-α-olefins is 80 mass % or more of all components, the viscosity at 40° C. is from 1,000 to 30,000 mPa·s, and the shear-thinning index at a shear rate of 1 to 10/s is 0.95 or more.

[2] The follower for a nonaqueous ballpoint pen as described in [1] above, wherein the viscosity of the follower at 40° C. is from 1,500 to 15,000 mPa·s.

[3] The follower for a nonaqueous ballpoint pen as described in [2] above, wherein the viscosity of the follower at 40° C. is from 3,000 to 10,000 mPa·s.

[4] The follower for a nonaqueous ballpoint pen as described in any one of [1] to [3] above, wherein the shear-thinning index of the follower at a shear rate of 1 to 10/s is 0.97 or more.

[5] The follower for a nonaqueous ballpoint pen as described in any one of [1] to [4] above, comprising at least one poly-α-olefin which is a synthetic oil having a viscosity of 200 mPa·s or more at 40° C., wherein the total amount of poly-α-olefins is 98 mass % or more of all components.

[6] The follower for a nonaqueous ballpoint pen as described in any one of [1] to [5] above, comprising at least one poly-α-olefin which is a synthetic oil having a viscosity of 1,000 mPa·s or more at 40° C., wherein the total amount of poly-α-olefins is 90 mass % or more of all components.

[7] The follower for a nonaqueous ballpoint pen as described in any one of [1] to [6] above, comprising at least one poly-α-olefin which is a synthetic oil having a viscosity of 5,000 mPa·s or more at 40° C., wherein the total amount of poly-α-olefins is 50 mass % or more of all components.

[8] The follower for a nonaqueous ballpoint pen as described in [7] above, comprising at least one poly-α-olefin which is a synthetic oil having a viscosity of 5,000 mPa·s or more at 40° C., wherein the total amount of poly-α-olefins is 60 mass % or more of all components.

[9] The follower for a nonaqueous ballpoint pen as described in [8] above, comprising at least one poly-α-olefin which is a synthetic oil having a viscosity of 5,000 mPa·s or more at 40° C.] above, wherein the total amount of poly-α-olefins is 70 mass % or more of all components.

[10] The follower for a nonaqueous ballpoint pen as described in any one of [1] to [9] above, wherein the poly-α-olefin is mainly a polymer of an α-olefin having a carbon number of 8 to 20.

[11] The follower for a nonaqueous ballpoint pen as described in any one of [1] to [9] above, wherein the poly-α-olefin is mainly a polymer of an α-olefin having a carbon number of 8 to 12.

[12] A nonaqueous ballpoint pen comprising a nonaqueous ballpoint pen ink and the follower for a nonaqueous ballpoint pen described in any one of [1] to [11] above, and using an ink reservoir tube having an inner diameter of 2.8 mm or less, the nonaqueous ballpoint pen ink being an ink in which a solvent comprising an alcohol and/or glycol monoether each having a vapor pressure of 0.2 to 50 mmHg at 20° C. occupies from 10 to 100 mass % of the ink solvent.

[13] The nonaqueous ballpoint pen as described in [12] above, wherein the concentration of water contained in the nonaqueous ballpoint pen ink is 5 mass % or less.

[14] The nonaqueous ballpoint pen as described in [12] above, wherein the nonaqueous ballpoint pen ink contains substantially no water.

[15] The nonaqueous ballpoint pen as described in any one of [12] to [14] above, wherein the nonaqueous ballpoint pen ink is an ink in which the solvent comprising an alcohol and/or glycol monoether of 0.2 to 50 mmHg occupies from 50 to 100 mass % of the ink solvent.

[16] The nonaqueous ballpoint pen as described in any one of [12] to [15] above, wherein the inner diameter of the ink reservoir tube is from 1.5 to 2.7 mm.

[17] The nonaqueous ballpoint pen as described in [16] above, wherein the inner diameter of the ink reservoir tube is from 1.6 to 2.6 mm.

MODE FOR CARRYING OUT THE INVENTION

Figure 1:
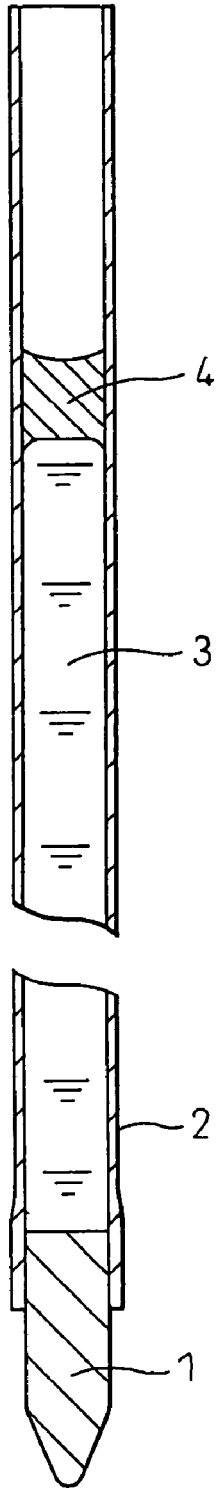
FIG. 1 is a schematic view showing one example of the ballpoint pen refill.

As a result of intensive studies on the reason why in a nonaqueous ballpoint pen unconventionally using a solvent having a high vapor pressure, the conventional follower for an aqueous ballpoint pen described in Background Art cannot be used as-is, the present inventors have found the following reasons.

The solvent used in a nonaqueous ballpoint pen ink has too strong an affinity for the follower solvent as compared with water, which is an aqueous ballpoint pen ink solvent. That is, the interfacial tension between the solvent used in the nonaqueous ballpoint pen ink and the follower solvent is lower than the interfacial tension between water and the follower solvent. By the effect of solvents having a strong affinity for each other, not only is a force of eliminating the interface generated at the interface between the ink and the follower, but also there arise various adverse effects, for example, in that the gel structure of the follower is destroyed, thereby accelerating oil separation, the physical properties are changed in aging due to destruction of the gel structure of the follower, the ink intrudes into the solid-liquid interface between the follower and the tube wall surface, or a solvent having volatility permeates through the follower and volatilizes. Furthermore, the coloring materials, resins and additives used in a nonaqueous ballpoint pen ink have, as a matter of course, higher affinity for the follower solvent than those used in an aqueous ballpoint pen, and therefore these migrate to the follower side and cause problems. In particular, when the ballpoint pen is left standing at a high temperature, such problems are particularly prominent.

Accordingly, the raw materials for use in the follower must have appropriate chemical and physical properties (physical values).

The present inventors have advanced studies, as a result, it has been found that when the follower is constructed by using a poly-α-olefin having a specific viscosity, more specifically, the follower is constructed by using a poly-α-olefin to have a viscosity of 1,000 to 30,000 mPa·s at 40° C. and a shear-thinning index of 0.95 or more at a shear rate of 1 to 10/s, the objective follower for a nonaqueous ballpoint pen, and a nonaqueous ballpoint pen containing such a follower can be provided.

As for the base oil used in the follower of the present invention, a poly-α-olefin, particularly, a poly-α-olefin which is a synthetic oil having a viscosity of 200 mPa·s or more at 40° C., is used. One poly-α-olefin which is a synthetic oil having a viscosity of 200 mPa·s or more at 40° C. may be used alone, or a mixture of two or more poly-α-olefins having a viscosity of 200 mPa·s or more at 40° C. and differing in viscosity may be used.

As the base oil of the follower for an aqueous ink, an alcohol, an ester, an organic acid, a silicon oil or the like having a low SP value (solubility parameter value) may be used other than hydrocarbon, but none of these can be used at least as the base oil of the follower for a nonaqueous ink or as a main component thereof. The alcohol, ester, organic acid or the like having a low SP value exhibits a strong affinity for the nonaqueous ink solvent, thereby rendering the interface undistinguishable or bringing about migration of coloring materials, resins, additives and the like used in the ink and cause problems. A silicone oil is not preferred, because the ink solvent readily permeates therethrough and the physical properties of the ink are changed in aging.

The poly-α-olefin is a hydrocarbon compound and in comparison with a mineral oil and a polybutene belonging to the same hydrocarbon, when the viscosity at 40° C. is the same, the poly-α-olefin tends to exhibit low compatibility or solubility with a substance having a relatively low SP value. This seems to infer that the affinity of the poly-α-olefin for the ink solvent and raw materials is particularly low among the hydrocarbon family. Therefore, problems considered to occur due to the above-described affinity for ink occur less as compared with other categories of hydrocarbon.

The poly-α-olefin is a synthetic oil obtained by polymerizing an α-olefin, and representative examples of the α-olefin as a reaction starting substance include 1-octene, 1-decene and 1-dodecene. Industrially, a polymer of 1-decene is being predominantly used. The reaction starting substance of the poly-α-olefin for use in the present invention is not particularly limited, but if the carbon number of α-olefin is small, the properties when the ballpoint pen is left standing upward at a high temperature are poor. Therefore, an α-olefin having a carbon number of 8 or more is preferred, and more preferably, the reaction starting substance mainly comprises an α-olefin having a carbon number of 8 to 20. As for "mainly comprises", this means that the content is 50 mass % or more. The content is preferably 60 mass % or more, more preferably 75 mass % or more, still more preferably 90 mass % or more, yet still more preferably 95 mass % or more.

The viscosity of the poly-α-olefin used as the base oil in the follower of the present invention is, in terms of the viscosity at 40° C., preferably 200 mPa·s or more, more preferably 500 mPa·s or more, still more preferably from 1,000 to 50,000 mPa·s or more, yet still more preferably from 1,500 to 20,000 mPa·s. Even when a poly-α-olefin is used, if a poly-α-olefin having a viscosity of less than 200 mPa·s at 40° C. is used in a certain amount or more, reversal readily occurs when the ballpoint pen is left standing upward at a high temperature. As the viscosity decreases, the molecular weight of the poly-α-olefin generally becomes smaller, and as the molecular weight becomes smaller, molecular motion takes place more vigorously at a high temperature and the affinity for ink raw materials increases, thereby encouraging mixing with ink (reducing the interfacial tension between the ink solvent and the follower solvent). As a result, reversal readily occurs when the ballpoint pen is left standing upward at a high temperature.

As the molecular weight of the poly-α-olefin increases, the affinity for raw materials is lowered even at a high temperature and reversal occurs less when the ballpoint pen is left standing upward at a high temperature. For example, the total amount of poly-α-olefins having a viscosity of 5,000 mPa·s or more at 40° C. is preferably 50 mass % or more of all components. Furthermore, the poly-α-olefins having a viscosity of 5,000 mPa·s or more at 40° C. are more preferably contained in a total amount of 60 mass % or more, still more preferably 70 mass % or more, of all components. When the total amount of poly-α-olefins having a viscosity of 5,000 mPa·s or more at 40° C. is 50 mass % or more, the affinity for raw materials decreases even at a high temperature and the effect of less occurrence reversal when the ballpoint pen is left standing upward at a high temperature is increased. Also, the poly-α-olefin having a viscosity of 5,000 mPa·s or more at 40° C. has a strong cohesive force of molecules and brings about a high surface tension, and therefore when the total amount of poly-α-olefins is 50 mass % or more of all components, this provides an effect of less occurrence of the phenomenon (dripping) wherein the follower drips in aging down the wall surface of the ink reservoir tube.

The follower of the present invention generally or preferably comprises at least one poly-α-olefin which is a synthetic oil having a viscosity of 200 mPa·s or more at 40° C., the total amount of poly-α-olefins being 100 mass %, but the follower of the present invention is sufficient if the poly-α-olefins are contained in a total amount of 80 mass % or more. That is, the follower of the present invention comprises poly-α-olefins having a viscosity of 200 mPa·s or more at 40° C. in a total amount of 80 mass % or more of all components. The total amount of poly-α-olefins having a viscosity of 200 mPa·s or more at 40° C. is more preferably 90 mass % or more, still more preferably 98 mass % or more, and most preferably more than 99.5 mass %, particularly 100 mass %. If the amount added of a raw material except for the poly-α-olefin is increased, the properties of the substance are reflected and when the substance has a high affinity for ink raw materials, reversal readily occurs when the ballpoint pen is left standing upward at a high temperature. Also, when the raw material except for the poly-α-olefin has low surface tension, the surface tension of the follower itself becomes low due to increased effect of the substance, and a phenomenon (dripping) wherein the follower drips in aging down the wall surface of the ink reservoir tube may occur. If the total amount of poly-α-olefins is 80 mass % or less of all components, the effect of a raw material except of the poly-α-olefin becomes excessively large and this is not preferred.

Examples of the above-described poly-α-olefin for use in the follower of the present invention include Barrel Process Oil P-380 (produced by Matsumura Oil Co., Ltd.), Barrel Process Oil P-1500 (produced by Matsumura Oil Co., Ltd.), Barrel Process Oil P-2200 (produced by Matsumura Oil Co., Ltd.), Barrel Process Oil P-10000 (produced by Matsumura Oil Co., Ltd.), Barrel Process Oil P-37500 (produced by Matsumura Oil Co., Ltd.), ExxonMobil SHF-403 (produced by Exxon Mobil Corp.), ExxonMobil SHF-1003 (produced by Exxon Mobil Corp.), SuperSyn 2150 (produced by Exxon Mobil Corp.), SuperSyn 2300 (produced by Exxon Mobil Corp.), SuperSyn 21000 (produced by Exxon Mobil Corp.) and SuperSyn 23000 (produced by Exxon Mobil Corp.). Many of these commercially available poly-α-olefins are mainly a polymer of 1-decene.

The poly-α-olefin is a synthetic oil, and therefore this is obtained as a mixture of poly-α-olefins having a molecular weight distribution after synthesis. The poly-α-olefin used as the base oil of the follower of the present invention preferably has a number average molecular weight (Mn) of 1,000 or more, more preferably from 3,000 to 20,000. The molecular weight distribution is estimated by the ratio of weight average molecular weight (Mw) to number average molecular weight (Mn), and the Mw/Mn value is used as a guide. This value is a large value when the molecular weight distribution is wide, and a value close to 1 when the molecular weight distribution is narrow. The poly-α-olefin which is a synthetic oil generally has a narrow molecular weight distribution as compared with a mineral oil and the like. In the follower of the present invention, when the poly-α-olefin used as the oil base has a low molecular weight, this results in an adverse effect as described above. Therefore, the Mw/Mn value is preferably close to 1. The Mw/Mn value of the poly-α-olefin for use as the base oil in the follower of the present invention is preferably 2.5 or less, more preferably 2.0 or less.

The measured values of Mw and Mn are obtained by a method of measurement such as gel permeation chromatography. Mw and Mn are represented by the following formulae, respectively (in the formulae, Mi represents a certain molecular weight, and Ni represents the number of polymers having the molecular weight Mi):

$$Mw=\Sigma(Mi^2Ni)/\Sigma(MiNi) \quad \text{formula (1)}$$

$$Mn=\Sigma(MiNi)/\Sigma Ni \quad \text{formula (2)}$$

In the follower of the present invention, such a poly-α-olefin is used, but it is necessary that the viscosity at 40° C. be from 1,000 to 30,000 mPa·s and the shear-thinning index at a shear rate of 1 to 10/s be 0.95 or more.

In the follower of the present invention, the viscosity at 40° C. is from 1,000 to 30,000 mPa·s, preferably from 1,500 to 15,000 mPa·s, more preferably from 3,000 to 10,000 mPa·s. If the follower has a viscosity of less than 1,000 mPa·s at 40° C., vigorous molecular motion occurs due to low viscosity, and the effect of a substance having a low molecular weight appears strong. Also, the cohesive force of the follower becomes low and the interfacial tension between the ink solvent and the follower solvent decreases. As a result, reversal is readily brought about when the ballpoint pen is left standing upward at a high temperature. Furthermore, since the surface tension decreases due to lowered cohesive force of the follower, the phenomenon (dripping) wherein the follower drips in aging down the wall surface of the ink reservoir tube is liable to occur. In some cases, due to the strong effect of a substance having a low molecular weight, the affinity for ink raw materials increases and a phenomenon such as diffusion of ink raw materials in the follower or difficulty in distinguishing the interface between ink and follower may occur. In addition, due to low viscosity, the ink raw materials tend to quickly diffuse into the follower. In particular, if the follower has a viscosity of 500 mPa·s or less at 40° C., the pen body produced has a low resistance to impact upon dropping of the pen at room temperature and the follower is splashed when the pen is dropped. If the follower has a viscosity exceeding 30,000 mPa·s at 40° C., due to following failure of the follower, starving or splitting occurs on writing at a high speed or at a low temperature of 5° C. or less.

The follower of the present invention must have a viscosity of 1,000 to 30,000 mPa·s at 40° C. and at the same time, a shear-thinning index of 0.95 or more at a shear rate of 1 to 10/s. The shear-thinning index is preferably 0.97 or more.

The shear-thinning index as used herein means a degree of change in the apparent viscosity when the shear rate is changed, and assuming that the shear-thinning index is n, the shear stress is τ, the shear rate is D and the apparent viscosity η, there is obtained a relationship as expressed by the following formula (1):

$$\tau=\eta D^n \quad \text{formula (3)}$$

If the shear-thinning index is less than 0.95, although the degree may differ greatly, depending on the viscosity of the follower, there arises a problem in that the amount of the follower attached to the wall surface increases at the time of consuming of the ink and the amount of the follower present in the rear end part of ink decreases as the ink is consumed. Also, the followability of the follower at low temperatures or at high-speed writing decreases, causing starving or splitting. In particular, if the shear-thinning index is 0.80 or less, although the degree may differ greatly, depending on the viscosity of the follower, if an air bubble is present in the refill, the air bubble cannot easily permeate through the follower even if the ballpoint pen is left standing with the pinpoint downward, and problems arise due to the effect of the air bubble.

In the present invention, a follower with good flowability is provided, which has a shear-thinning index of 0.95 or more so as not to cause a problem in the followability of the follower at low temperatures or during high-speed writing even when the follower is contained in an ink reservoir tube of 2.8 mm or less having a strong tube resistance, and therefore one characteristic feature of the follower of the present invention is to contain fundamentally no shear-thinning property-imparting agent. A follower with good flowability is, depending on the storage conditions, liable to cause reversal due to a difference in gravity from the ink when the ballpoint pen is left standing upward, but in the follower of the present invention, this problem of reversal due to standing upward can be overcome simply by utilizing the force (interfacial tension) of keeping the ink and the follower unmixed, the surface tension of the follower, and the tube resistance of the ink reservoir tube. This is a novel technical idea not seen in conventional followers.

Conventionally, a so-called thickener is used for raising the viscosity of the follower, but a conventionally employed thickener exhibits a shear-thinning property and when a follower using such a thickener is contained in an ink reservoir tube of 2.8 mm or less having a strong tube resistance, there arises a problem in the followability of the follower at low temperatures or during high-speed writing. In the follower of the present invention, the thickener cannot be used at least in a substantial amount.

In the follower of the present invention, when the above-described poly-olefin is selected and designed so as to have a viscosity of 1,000 to 30,000 mPa·s at 40° C., the shear-thinning index generally becomes 0.95 or more. In other words, since the follower of the present invention has a shear-thinning index of 0.95 or more at a shear rate of 1 to 10/s, this means that the viscosity of the follower is adjusted to the above-described range by not increasing the viscosity with use of a thickener of conventional type (a type for imparting shear-thinning property), but by using a poly-α-olefin having an appropriate viscosity at least as a main viscosity-adjusting component.

Examples of the conventionally employed thickener or gelling agent for imparting a shear-thinning property include a metal soap, an organic bentonite, an inorganic metal fine particle, waxes and a thermoplastic elastomer. In the present invention, such a thickener or gelling agent for imparting a shear-thinning property is fundamentally not used. However, such a thickener or gelling agent may be used within a range such as not to decrease the shear-thinning index at a shear rate of 1 to 10/s to less than 0.95, but if used in a substantial amount for decreasing the shear-thinning index at a shear rate of 1 to 10/s to less than 0.95, the above-described problems occur and this is out of the scope of the present invention.

The base oil for use in the follower of the present invention is preferably sparingly volatile and/or nonvolatile at an ordinary temperature, because if the solvent is volatile, the evaporation loss increases and the function as a follower cannot be exerted. The evaporation loss under the conditions of 98° C. and 5 hours is preferably 0.4 mass % or less. If the evaporation loss exceeds 0.4 mass %, volatilization of the follower base oil cannot be avoided and the physical properties of the follower are changed in aging.

The follower of the present invention, as described above, comprises at least one poly-α-olefin which is a synthetic oil having a viscosity of 200 mPa·s or more at 40° C., but as long as these viscosity and shear-thinning indexes are satisfied and the follower performance are not adversely affected, other oil, resin, thickener and additive may be added. Examples of other oil, resin, thickener and additive include a mineral oil, a polybutene, a terpene resin, a surfactant and a silicon oil. For example, in the case of using a poly-α-olefin having a viscosity of less than 1,000 mPa·s at 40° C., a certain thickener may be used. However, also in this case, the viscosity is preferably increased by a substance having a low affinity for ink raw materials as much as possible without using, as the thickener, a substance causing an increase in the affinity for ink raw materials.

The amount added of such thickener and additive is, in total including those aggressively added and those passively added, preferably less than 20 mass %, more preferably less than 10 mass %, still more preferably less than 2 mass %, and most preferably 0.5% or less, based on the entire amount of the follower. If the amount added is 20 mass % or more, the properties of the additive are strongly reflected and an adverse effect or the like may readily occur due to intensified interaction with the ink raw materials. Also, in the case of a substance having a large polarity, the affinity between the follower and the ink is significantly enhanced, and therefore it is not preferred to add such a substance in an amount of 5 mass % or more, even 3 mass % or more, still even 0.5 mass % or more.

In the follower of the present invention, a poly-α-olefin which is a synthetic oil having a viscosity of 200 mPa·s or more at 40° C. is used as it is, or two or more thereof are mixed and used. In the case of mixing two or more poly-α-olefins and in the case of blending other oil, resin, thickener and additive, these are heated with stirring and then cooled to room temperature. The stirring temperature is not particularly limited, as long as the follower raw materials become uniform, but the stirring temperature is preferably from 50 to 200° C., more preferably from 70 to 140° C., still more preferably from 90 to 120° C. If the stirring temperature is less than 50° C., when a high-viscosity poly-α-olefin is mixed, it takes much time to obtain a uniform solution, whereas if the stirring temperature exceeds 200° C., the follower raw materials are readily oxidized and the physical properties of the finished product differ greatly, depending on the stirring time. Also, when the oxide concentration is increased in the follower, the affinity for ink raw materials is enhanced and a problem may arise in the reversing property during standing upward at a high temperature.

In order to prevent oxidation of follower raw materials, the stirring may be performed in a nitrogen atmosphere.

As for the environment of cooling after stirring under heat, the cooling may be performed in any environment, as long as the follower obtained after cooling exhibits almost the same physical properties in any portion of the container. However, when the cooling conditions are not controlled and the obtained follower exhibits different physical properties in a portion within the container, the cooling conditions are preferably controlled, for example, by controlling the cooling rate or applying vibration.

The follower of the present invention has been developed for use with a nonaqueous ballpoint pen ink. In the present invention, the nonaqueous ballpoint pen ink means an ink containing substantially no water, but the nonaqueous solvent such as alcohol has hydrophilicity and sometimes naturally absorbs moisture in aging to equilibrate while containing water. Also, water is sometimes appropriately incorporated during the production of ink so as to reduce the change in physical properties of the ink which absorbs moisture. However, the water concentration should not exceed 5 mass % at the time of production of ink.

The follower of the present invention is intended to prevent volatilization of the ink solvent, but also to prevent absorption of moisture into the ink.

A solvent comprising alcohols and glycol monoethers is relatively liable to absorb moisture in air. When the ink absorbs moisture, the physical properties of the ink or the solubility of raw material may be changed and this may adversely affect the writing property of the ballpoint pen. In order to inhibit such an adverse effect, a follower is necessary.

From the reason described above, the follower of the present invention is suitably used with a nonaqueous ballpoint pen ink, particularly, a nonaqueous ballpoint ink comprising a ballpoint ink solvent in which a solvent comprising alcohols and glycol monoethers each having a vapor pressure of 0.2 to 50 mmHg at 20° C. occupies from 10 to 100 mass % of the ink solvent.

As for the solvent having a vapor pressure of 0.2 to 50 mmHg at 20° C., examples of the alcohols include ethanol, 1-propanol, 2-propanol, 1-butanol, 2-butanol, iso-butyl alcohol, tert-butyl alcohol, 1-pentanol, 2-pentanol, 3-pentanol, iso-pentyl alcohol, tert-pentyl alcohol, 3-methyl-2-butanol, neopentyl alcohol, 1-hexanol, 2-methyl-1-pentanol, 4-methyl-2-pentanol, 2-ethyl-1-butanol, n-heptanol, 2-heptanol and 3-heptanol.

Examples of the glycol monoethers include ethylene glycol monomethyl ether, ethylene glycol monoethyl ether, ethylene glycol monopropyl ether, ethylene glycol monobutyl ether, propylene glycol monomethyl ether, propylene glycol monoethyl ether, propylene glycol monopropyl ether, propylene glycol monobutyl ether, propylene glycol tertiary butyl ether, 3-methoxybutanol and 3-methyl-3-methoxybutanol.

Also, glycol monoesters can be used similarly to the glycol monoethers.

In the case where the above-described solvent occupies from 10 to 100 mass %, furthermore from 30 to 100 mass %, or particularly from 50 to 100 mass %, of the ink solvent, a follower is necessary so as to prevent the change in aging of the ink quality due to volatilization of the ink solvent from the rear end part. The follower of the present invention is optimal for this purpose.

In combination with the above-described solvent, a non-volatile solvent may be used as an auxiliary solvent within the range of 0 to 90 mass % of the ink solvent.

The nonaqueous ballpoint pen ink composition requiring the follower of the present invention necessarily contains a coloring material and a resin in addition to those solvents. The coloring material is prepared by using a pigment or a dye or using a pigment and a dye in combination, and the resin may be any resin, as long as it can bring out the performance of the nonaqueous ballpoint pen and does not become an unstable factor in the ink.

Also, various additives can be used according to the performance. The viscosity of the ink is preferably 20,000 mPa·s or less at 25° C.

By virtue of the above-described construction, the present invention has succeeded in providing a follower which can be used also for a nonaqueous ballpoint pen using a solvent having a high vapor pressure, is stable without undergoing separation even during storage at a high temperature or for a long period of time, prevents volatilization of ink by sealing the ink from the outer air, causes no problem in the followability of the follower at low temperatures or at high-speed writing even when the follower is contained in an ink reservoir tube with strong tube resistance having an inner diameter of 2.8 mm or less, ensures resistance against impact on dropping, has low susceptibility to reversal between the ink and the follower due to a difference in gravity when the pen is left standing with the penpoint upward, has low resistance to the phenomenon (dripping) wherein the follower drips in aging down the wall surface of the ink reservoir tube, is less reduced in the amount of the follower at the rear end part of ink as the ink is consumed, and substantially prevents the presence of an air bubble inside the refill, and also provides a nonaqueous ballpoint pen containing such a follower.

The inner diameter of the ink reservoir in which the follower of the present invention is contained is preferably 2.8 mm or less, more preferably from 1.5 to 2.7 mm, still more preferably from 1.6 to 2.6 mm. The follower of the present invention facilitates good followability and good flowability even in an ink reservoir tube with high tube resistance having an inner diameter of 2.8 mm or less, and the effect of the follower of the present invention is remarkable. If the inner diameter of the ink reservoir tube is less than 1.5 mm, the tube resistance becomes strong and irrespective of the presence or the absence of a follower, starving or splitting due to following failure may occur during high-speed writing and this is not preferred.

The construction material of the ink reservoir tube in which the follower of the present invention is contained is not particularly limited, as long as the quality of the ballpoint pen is not seriously impaired by the effect of the ink solvent or follower solvent or by the effect from the outside.

As the construction material of the ink reservoir tube which comes into contact with the ink solvent or follower solvent, a polypropylene, a polyethylene, a metal or the like is used.

The follower of the present invention can be used, in addition to use for a nonaqueous ballpoint pen, with other inks such as aqueous ink for an aqueous ballpoint pen where the ink is directly housed in the ink reservoir tube.

FIG. 1 schematically shows one example of the ballpoint pen refill. A metal-made ballpoint pen tip 1 is liquidtightly connected to one end part of a transparent plastic-made ink reservoir tube 2. Although various structures are known for the tip 1, a metal-made or ceramic-made ball (not shown) is present at the distal end thereof and an ink 3 in the ink reservoir tube 2 passes through the inside of the tip 1 to effect writing by the ball at the distal end. A follower 4 is mounted in the rear of the ink 3 within the ink reservoir tube 2 and as the ink 3 decreases in quantity, the follower 4 follows the movement of the rear end part of the ink 3.

The nonaqueous ballpoint pen using the specific follower of the present invention, particularly a nonaqueous ballpoint pen in which an ink solvent having high volatility is used, is novel, and practical use of a nonaqueous ballpoint pen using an ink solvent having high volatility is first realized by use of this follower.

EXAMPLES

The present invention is described in detail below by referring to Examples, but the present invention is not limited to these Examples.

The raw materials used in Examples and Comparative Examples are as follows.

(1) Barrel Process Oil P2200

Poly-α-olefin; viscosity at 40° C.: 2,000 mPa·s (shear rate: 3.8/s)

(2) Barrel Process Oil P37500

Poly-α-olefin; viscosity at 40° C.: 32,000 mPa·s (shear rate: 3.8/s)

(3) Barrel Process Oil P10000

Poly-α-olefin; viscosity at 40° C.: 8,900 mPa·s (shear rate: 3.8/s)

(4) Barrel Process Oil P1500

Poly-α-olefin; viscosity at 40° C.: 1,300 mPa·s (shear rate: 3.8/s)

(5) ExxonMobil SHF-403

Poly-α-olefin; viscosity at 40° C.: 350 mPa·s (shear rate: 3.8/s)

(6) Diana Process Oil PW-90

Mineral oil; viscosity at 40° C.: 90 mPa·s (shear rate: 3.8/s)

(7) Idemitsu PA05006

Poly-α-olefin; viscosity at 40° C.: 27 mPa·s (shear rate: 3.8/s)

(8) Diana Process Oil PW-8

Mineral oil; viscosity at 40° C.: 8 mPa·s (shear rate: 3.8/s)

(9) Idemitsu Polybutene 2000H

Polybutene; viscosity at 40° C.: 230,000 mPa·s (shear rate: 3.8/s)

(10) Aerosil R-972

Fine particulate silica; shear-thinning property-imparting agent

(11) Clearon P-105

Terpene resin; thickener

Example 1

Barrel Process Oil P-2200 (produced 100.0 mass % by Matsumura Oil Co., Ltd.)

This material was directly used as the follower. The viscosity at 40° C. was 2,000 mPa·s (shear rate: 3.8/s), and the shear-thinning index at a shear rate of 1 to 10/s was 1.00.

Example 2

Barrel Process Oil P-2200 (produced 80.0 mass % by Matsumura Oil Co., Ltd.)

Barrel Process Oil P-37500 (produced 20.0 mass % by Matsumura Oil Co., Ltd.)

These materials were heated with stirring at 90° C. for 30 minutes and then allowed to cool to room temperature, whereby 50 g of a follower was obtained.

The viscosity at 40° C. of the obtained follower was 4,100 mPa·s (shear rate: 3.8/s), and the shear-thinning index at a shear rate of 1 to 10/s was 0.99.

Example 3

Barrel Process Oil P-2200 (produced 40.0 mass % by Matsumura Oil Co., Ltd.)

Barrel Process Oil P-10000 (produced 60.0 mass % by Matsumura Oil Co., Ltd.)

These materials were heated with stirring at 90° C. for 30 minutes and then allowed to cool to room temperature, whereby 50 g of a follower was obtained.

The viscosity at 40° C. of the obtained follower was 5,400 mPa·s (shear rate: 3.8/s), and the shear-thinning index at a shear rate of 1 to 10/s was 1.00.

Example 4

Barrel Process Oil P-1500 (produced 20.0 mass % by Matsumura Oil Co., Ltd.)

Barrel Process Oil P-10000 (produced 80.0 mass % by Matsumura Oil Co., Ltd.)

These materials were heated with stirring at 90° C. for 30 minutes and then allowed to cool to room temperature, whereby 50 g of a follower was obtained.

The viscosity at 40° C. of the obtained follower was 6,700 mPa·s (shear rate: 3.8/s), and the shear-thinning index at a shear rate of 1 to 10/s was 1.01.

Example 5

ExxonMobil SHF-403 (produced by 25.0 mass % Exxon Mobil Corp.)

Barrel Process Oil P-10000 (produced 75.0 mass % by Matsumura Oil Co., Ltd.)

These materials were heated with stirring at 90° C. for 30 minutes and then allowed to cool to room temperature, whereby 50 g of a follower was obtained.

The viscosity at 40° C. of the obtained follower was 4,600 mPa·s (shear rate: 3.8/s), and the shear-thinning index at a shear rate of 1 to 10/s was 0.99.

Example 6

Barrel Process Oil P-10000 (produced 80.0 mass % by Matsumura Oil Co., Ltd.)

Barrel Process Oil P-37500 (produced 20.0 mass % by Matsumura Oil Co., Ltd.)

These materials were heated with stirring at 90° C. for 30 minutes and then allowed to cool to room temperature, whereby 50 g of a follower was obtained.

The viscosity at 40° C. of the obtained follower was 12,600 mPa·s (shear rate: 3.8/s), and the shear-thinning index at a shear rate of 1 to 10/s was 0.98.

Comparative Example 1

Barrel Process Oil P-2200 (produced 40.0 mass % by Matsumura Oil Co., Ltd.)

Barrel Process Oil P-37500 (produced 35.0 mass % by Matsumura Oil Co., Ltd.)

Diana Process Oil PW-90 (produced by 25.0 mass % Idemitsu Kosan Co., Ltd.)

These materials were heated with stirring at 90° C. for 30 minutes and then allowed to cool to room temperature, whereby 50 g of a follower was obtained.

The viscosity at 40° C. of the obtained follower was 3,800 mPa·s (shear rate: 3.8/s), and the shear-thinning index at a shear rate of 1 to 10/s was 1.00.

Comparative Example 2

Barrel Process Oil P-10000 (produced 75.0 mass % by Matsumura Oil Co., Ltd.)

Idemitsu PA05006 (produced by 25.0 mass % Idemitsu Petrochemical Co., Ltd.)

These materials were heated with stirring at 90° C. for 30 minutes and then allowed to cool to room temperature, whereby 50 g of a follower was obtained.

The viscosity at 40° C. of the obtained follower was 2,700 mPa·s (shear rate: 3.8/s), and the shear-thinning index at a shear rate of 1 to 10/s was 0.99.

Comparative Example 3

Barrel Process Oil P-2200 (produced 82.0 mass % by Matsumura Oil Co., Ltd.)

Diana Process Oil PW-8 (produced by 18.0 mass % Idemitsu Kosan Co., Ltd.)

These materials were heated with stirring at 90° C. for 30 minutes and then allowed to cool to room temperature, whereby 50 g of a follower was obtained.

The viscosity at 40° C. of the obtained follower was 850 mPa·s (shear rate: 3.8/s), and the shear-thinning index at a shear rate of 1 to 10/s was 0.99.

Comparative Example 4

Barrel Process Oil P-1500 (produced 93.0 mass % by Matsumura Oil Co., Ltd.)

Diana Process Oil PW-8 (produced by 7.0 mass % Idemitsu Kosan Co., Ltd.)

These materials were heated with stirring at 90° C. for 30 minutes and then allowed to cool to room temperature, whereby 50 g of a follower was obtained.

The viscosity at 40° C. of the obtained follower was 900 mPa·s (shear rate: 3.8/s), and the shear-thinning index at a shear rate of 1 to 10/s was 0.99.

Comparative Example 5

Barrel Process Oil P-37500 (produced 91.0 mass % by Matsumura Oil Co., Ltd.)

Idemitsu Polybutene 2000H (produced 9.0 mass % by Idemitsu Petrochemical Co., Ltd.)

These materials were heated with stirring at 90° C. for 30 minutes and then allowed to cool to room temperature, whereby 50 g of a follower was obtained.

The viscosity at 40° C. of the obtained follower was 39,500 mPa·s (shear rate: 3.8/s), and the shear-thinning index at a shear rate of 1 to 10/s was 0.98.

Comparative Example 6

Barrel Process Oil P-2200 (produced 95.5 mass % by Matsumura Oil Co., Ltd.)

Aerosil R-972 (produced by Nippon 3.0 mass % Aerosil Co., Ltd.)

Clearon P-105 (produced by Idemitsu 1.5 mass % Kosan Co., Ltd.)

These materials were heated with stirring at 90° C. for 30 minutes and then allowed to cool to room temperature, whereby 50 g of a stirred solution was obtained.

The stirred solution was kneaded by a three-roll mill to obtain a follower.

The viscosity at 40° C. of the obtained follower was 4,200 mPa·s (shear rate: 3.8/s), and the shear-thinning index at a shear rate of 1 to 10/s was 0.84.

Comparative Example 7

Barrel Process Oil P-2200 (produced 70.0 mass % by Matsumura Oil Co., Ltd.)

Barrel Process Oil P-10000 (produced 18.0 mass % by Matsumura Oil Co., Ltd.)

Aerosil R-972 (produced by Nippon 8.0 mass % Aerosil Co., Ltd.)

Clearon P-105 (produced by Idemitsu 4.0 mass % Kosan Co., Ltd.)

These materials were heated with stirring at 90° C. for 30 minutes and then allowed to cool to room temperature, whereby 50 g of a stirred solution was obtained.

The stirred solution was kneaded by a three-roll mill to obtain a follower.

The viscosity at 40° C. of the obtained follower was 17,100 mPa·s (shear rate: 3.8/s), and the shear-thinning index at a shear rate of 1 to 10/s was 0.56.

Comparative Example 8

Barrel Process Oil P-1500 (produced 70.0 mass % by Matsumura Oil Co., Ltd.)

Diana Process Oil PW-8 (produced by 30.0 mass % Idemitsu Kosan Co., Ltd.)

These materials were heated with stirring at 90° C. for 30 minutes and then allowed to cool to room temperature, whereby 50 g of a follower was obtained.

The viscosity at 40° C. of the obtained follower was 300 mPa·s (shear rate: 3.8/s), and the shear-thinning index at a shear rate of 1 to 10/s was 1.00.

(Evaluation Methods and Results)

The followers obtained according to the above-described formulations and preparation methods were each combined with a nonaqueous ink shown below and evaluated by way of the following evaluation tests. The results obtained are shown in Table 1.

Incidentally, after the filling of ink and follower, the refill was centrifuged at 2,000 rpm for 5 minutes by using a centrifugal separator, Model H-103N, manufactured by Kokusan Enshinki Co., Ltd. to apply a centrifugal force in the direction from the tail end part of the pen to the penpoint.

In Examples and Comparative Examples, an ink reservoir tube having an inner diameter of 2.4 mm with the inner wall being formed of polypropylene was used and combined with a penpoint consisting of a connector and a tip to obtain a refill, and this refill was inserted into the shaft of UM-100 manufactured by Mitsubishi Pencil Co., Ltd., thereby producing a pen body.

In the pen body employing a combination of the nonaqueous ink and the follower, a tip having a ball diameter of 1.0 mm was used.

<Nonaqueous Ink Blending>

| | |
|---|---|
| Spiron Violet C-RH (produced by Hodogaya Chemical Co., Ltd.) | 18.0 mass % |
| Spiron Yellow C-GNH (produced by Hodogaya Chemical Co., Ltd.) | 7.0 mass % |
| Polyvinyl Butyral BM-1 (produced by Sekisui Chemical Co., Ltd.) | 1.0 mass % |
| SK Resin (produced by Huels Ltd.) | 1.0 mass % |
| Activator | 9.0 mass % |
| 3-Methoxy, 3-methyl, 1-butanol | 64.0 mass % |

<Evaluation Tests>

1) Reversing Property in Standing Upward

The pen body was left standing with the penpoint upward for 10 days in an environment of 70° C., and the occurrence or lack of reversal between the ink and the follower was observed. The evaluation criteria are as follows.

Not reversed: A

Partially reversed: B

Mostly reversed: C

2) Dripping Property

In an environment of 70° C., only the follower was filled but the ink was not filled. The pen body was left standing with the penpoint upward for 10 days and the degree in which the follower dripped (flowed) down the inner wall of the tube was observed and evaluated according to the following criteria.

Not dripped: A

The follower partially dripped but pooled on the downside and then integrated to again seal the entire ink reservoir tube: B The follower in a fairly large portion dripped and moved to the downside: C 3) High-Speed Writing Property A spiral line (diameter: about 5 cm) was written on PPC paper and the degree of starving or splitting was observed and evaluated according to the following criteria:

Almost no starving or splitting: A

Some starving or splitting: B

Serious starving or splitting: C

4) Diffusion Property (i)

The pen body was left standing with the penpoint downward for 10 days in an environment of 70° C. and the state at the interface between ink and follower was observed and evaluated according to the following criteria.

Clear interface: A

Unclear boundary of the interface: B

Significantly unclear boundary of the interface: C

5) Diffusion Property (ii)

The pen body was left standing with the penpoint downward for 10 days in an environment of 70° C., and the diffusion of the dye into the follower was observed and evaluated according to the following criteria.

Almost no diffusion of dye into follower: A

Some diffusion of dye into follower: B

Significant diffusion of dye into follower: C

6) Sticking Property to Wall Surface

The pen body was subjected to 300-m writing at a rate of 4.5 m/min and the amount of the follower in the rear end part of ink was observed before and after the writing and evaluated according to the following criteria.

Not so much change in the amount of follower: A

Some change in the amount of follower: B

Significant change in the amount of follower: C

7) Resistance Against Impact on Dropping

The pen body was continuously dropped five times from a height of about 1 m, and the state in the rear end part of follower was observed and evaluated according to the following criteria.

No change: A

The interface at the rear end part of follower was disordered and the follower was splashed on the tube wall surface: C

TABLE 1

| Evaluation | | Example | | | | | |
|---|---|---|---|---|---|---|---|
| Method | Evaluation Item | 1 | 2 | 3 | 4 | 5 | 6 |
| Evaluation 1 | Upward Standing Property | A | A | A | A | A | A |
| Evaluation 2 | Dripping Property | A | A | A | A | A | A |
| Evaluation 3 | High-Speed Writing Property | A | A | A | A | A | A |
| Evaluation 4 | Diffusion Property (i) | A | A | A | A | A | A |
| Evaluation 5 | Diffusion Property (ii) | A | A | A | A | A | A |
| Evaluation 6 | Sticking to Wall Surface | A | A | A | A | A | A |
| Evaluation 7 | Impact on Dropping | A | A | A | A | A | A |

| Evaluation | | Comparative Example | | | | | | | |
|---|---|---|---|---|---|---|---|---|---|
| Method | Evaluation Item | 1 | 2 | 3 | 4 | 5 | 6 | 7 | 8 |
| Evaluation 1 | Upward Standing Property | B | B | C | C | A | B | B | C |
| Evaluation 2 | Dripping Property | A | B | C | C | A | A | A | C |
| Evaluation 3 | High-Speed Writing Property | A | A | A | A | B | A | C | A |
| Evaluation 4 | Diffusion Property (i) | A | A | B | B | A | B | B | B |
| Evaluation 5 | Diffusion Property (ii) | B | B | B | B | A | A | A | B |

-continued

| Evaluation | | Comparative Example | | | | | | | |
|---|---|---|---|---|---|---|---|---|---|
| Method | Evaluation Item | 1 | 2 | 3 | 4 | 5 | 6 | 7 | 8 |
| Evaluation 6 | Sticking to Wall Surface | A | A | A | A | C | B | C | A |
| Evaluation 7 | Impact on Dropping | A | A | A | A | A | A | A | C |

In all of Examples 1 to 6, there was no problem.

Comparative Example 1 is a follower where the total amount of poly-α-olefins which are a synthetic oil having a viscosity of 200 mPa·s or more at 40° C. is 80 mass % or less of all components.

A paraffin-based mineral oil was used as the raw material except for the poly-α-olefin, but the properties of this substance were reflected and due to a strong affinity of the substance for ink raw materials, reversal occurred in a part of the follower when the pen body was left standing upward at a high temperature.

Also, due to a strong affinity for ink raw materials, diffusion of dye into the follower was observed.

Comparative Example 2 is a follower where all components are a poly-α-olefin, but the total amount of poly-α-olefins which are a synthetic oil having a viscosity of 200 mPa·s or more is 80 mass % or less of all components.

Similarly to Comparative Example 1, the properties of the poly-α-olefin which is a synthetic oil having a viscosity of 200 mPa·s or less were reflected and due to strong affinity of the substance for ink raw materials, reversal occurred in a part of the follower when the pen body was left standing upward at a high temperature. Also, due to a strong affinity for ink raw materials, diffusion of dye into the follower was observed.

Furthermore, due to a decrease in the surface tension as a result of the effect of the poly-α-olefin which is a synthetic oil of 200 mPa·s or less, the phenomenon (dripping) wherein the follower drips in aging down the wall surface of the ink reservoir tube was observed.

Comparative Examples 3 and 4 are each a follower having a viscosity of 1,000 mPa·s or less at 40° C.

A paraffin-based mineral oil having a low viscosity was used as the raw material, except for the poly-α-olefin.

Due to low viscosity of the follower and occurrence of vigorous molecular motion, the properties of the substance having a low molecular weight exerted a prominent effect and the affinity for ink raw materials was strengthened. As a result, reversal occurred when the pen body was left standing upward at a high temperature.

Also, due to a reduction in the cohesive force of molecules and in turn a decrease in the surface tension, the phenomenon (dripping) occurred in which the follower drips in aging down the wall surface of the ink reservoir tube.

Furthermore, due to effect of the substance having a low molecular weight or due to low viscosity allowing for ready occurrence of diffusion, not only was the affinity for ink raw materials increased and diffusion of ink dye into the follower observed, but also the interface between ink and follower became hardly distinguishable.

Comparative Example 5 is a follower having a viscosity of 30,000 mPa·s or more at 40° C.

When high-speed writing was performed, starving or splitting due to following failure of the follower occurred. Also, despite the shear-thinning index of 0.95 or more, the amount of the follower attached to the wall surface increased at the time of consuming of the ink, and this resulted in a problem in that the amount of the follower present in the rear end part of ink decreases greatly as the ink is consumed.

Comparative Examples 6 and 7 are each a follower having a shear-thinning index of 0.95 or less at a shear rate of 1 to 10/s.

The amount of the follower attached to the wall surface was increased at the time of consuming of the ink, and this resulted in a problem in that the amount of the follower present in the rear end part of ink decreases as the ink is consumed.

In Comparative Example 6, due to a relatively high shear-thinning index and not so high viscosity, the amount of the follower attached to the wall surface was somewhat larger, and this resulted in a problem in that the amount of the follower present in the rear end part of ink decreases as the ink is consumed.

Furthermore, due to the strong affinity of Aerosil R972 as a fine particulate silica and P105 as a terpene resin for ink raw materials, reversal occurred in a part of the follower.

In addition, due to the strong affinity of Aerosil R972 as a fine particulate silica and P105 as a terpene resin for ink raw materials, the phenomenon occurred wherein the interface between ink and follower becomes hardly distinguishable.

In Comparative Example 7, due to a relatively low shear-thinning index and relatively high viscosity, the amount of the follower attached to the wall surface increased, and this resulted in a problem in that the amount of the follower present in the rear end part of ink decreases greatly as the ink is consumed.

Also, when high-speed writing was performed, starving or splitting due to following failure of the follower occurred.

Furthermore, due to the strong affinity of Aerosil R972 as a fine particulate silica and P105 as a terpene resin for ink raw materials, reversal occurred in a part of the follower.

In addition, due to the strong affinity of Aerosil R972 as a fine particulate silica and P105 as a terpene resin for ink raw materials, the phenomenon occurred wherein the interface between ink and follower becomes hardly distinguishable.

Comparative Example 8 is a follower having a very low viscosity of 300 mPa·s at 40° C.

In addition to the problems encountered in Comparative Examples 4 to 5, the follower was splashed due to impact on dropping.

As is apparent from these results, it was verified that the followers for a nonaqueous ballpoint pen of Examples 1 to 7 within the scope of the present invention are most excellent in terms of reversing property in standing upward, dripping property, high-speed writing property, diffusion property, sticking property to the wall surface of ink reservoir tube and resistance to impact on dropping, as compared with the followers for a nonaqueous ballpoint pen of Comparative Examples 1 to 8, which are out of the scope of the present invention.

INDUSTRIAL APPLICABILITY

According to the present invention, a follower for a nonaqueous ballpoint pen, which is most excellent in terms of reversing property in standing upward, dripping property, high-speed writing property, diffusion property, sticking property to wall surface of ink reservoir tube and resistance to impact on dropping, can be provided. In particular, a follower for a nonaqueous ballpoint pen, which exerts an excellent effect in a nonaqueous ballpoint pen using, unlike conventional nonaqueous ballpoint pens, an ink solvent having a high volatility, can be provided. Furthermore, a nonaqueous ballpoint pen using an ink solvent having high volatility and using an ink reservoir tube having an inner diameter of 2.8 mm or less is also provided.

The invention claimed is:

1. A follower for a nonaqueous ballpoint pen, comprising at least one poly-α-olefin which is a synthetic oil having a viscosity of 200 mPa·s or more at 40° C., wherein the total amount of poly-α-olefins is 80 mass % or more of all components, the viscosity at 40° C. is from 1,000 to 30,000 mPa·s, and the shear-thinning index at a shear rate of 1 to 10/s is 0.95 or more.

2. The follower for a nonaqueous ballpoint pen as claimed in claim 1, wherein the viscosity of the follower at 40° C. is from 1,500 to 15,000 mPa·s.

3. The follower for a nonaqueous ballpoint pen as claimed in claim 2, wherein the viscosity of the follower at 40° C. is from 3,000 to 10,000 mPa·s.

4. The follower for a nonaqueous ballpoint pen as claimed in claim 1, wherein the shear-thinning index of the follower at a shear rate of 1 to 10/s is 0.97 or more.

5. The follower for a nonaqueous ballpoint pen as claimed in claim 1, wherein the total amount of poly-α-olefins is 98 mass % or more of all components.

6. The follower for a nonaqueous ballpoint pen as claimed in claim 1, wherein said poly-α-olefin comprises at least one poly-α-olefin which is a synthetic oil having a viscosity of 1,000 mPa·s or more at 40° C., wherein the total amount of said poly-α-olefin having a viscosity of 1,000 mPa·s or more at 40° C. is 90 mass % or more of all components.

7. The follower for a nonaqueous ballpoint pen as claimed in claim 1, wherein said poly-α-olefin comprises at least one poly-α-olefin which is a synthetic oil having a viscosity of 5,000 mPa·s or more at 40° C., wherein the total amount of said poly-α-olefin having a viscosity of 5,000 mPa·s or more at 40° C. is 50 mass % or more of all components.

8. The follower for a nonaqueous ballpoint pen as claimed in claim 7, wherein said poly-α-olefin comprises at least one poly-α-olefin which is a synthetic oil having a viscosity of 5,000 mPa·s or more at 40° C., wherein the total amount of said poly-α-olefin having a viscosity of 5,000 mPa·s or more at 40° C. is 60 mass % or more of all components.

9. The follower for a nonaqueous ballpoint pen as claimed in claim 8, wherein said poly-α-olefin comprises at least one poly-α-olefin which is a synthetic oil having a viscosity of 5,000 mPa·s or more at 40° C., wherein the total amount of said poly-α-olefin having a viscosity of 5,000 mPa·s or more at 40° C. is 70 mass % or more of all components.

10. The follower for a nonaqueous ballpoint pen as claimed in claim 1, wherein the poly-α-olefin is mainly a polymer of an α-olefin having a carbon number of 8 to 20.

11. The follower for a nonaqueous ballpoint pen as claimed in claim 1, wherein the poly-α-olefin is mainly a polymer of an α-olefin having a carbon number of 8 to 12.

12. A nonaqueous ballpoint pen comprising a nonaqueous ballpoint pen ink and the follower for a nonaqueous ballpoint pen claimed in claim 1, and using an ink reservoir tube having an inner diameter of 2.8 mm or less, the nonaqueous ballpoint pen ink being an ink in which a solvent comprising an alcohol and/or glycol monoether having a vapor pressure of 0.2 to 50 mmHg at 20° C. occupies from 10 to 100 mass % of the ink solvent.

13. The nonaqueous ballpoint pen as claimed in claim 12, wherein said solvent contains water in an amount of 5 mass % or less of the solvent.

14. The nonaqueous ballpoint pen as claimed in claim 12, wherein the nonaqueous ballpoint pen ink contains substantially no water.

15. The nonaqueous ballpoint pen as claimed in claim 12, wherein the nonaqueous ballpoint pen ink is an ink in which the solvent comprising an alcohol and/or glycol monoether of 0.2 to 50 mmHg occupies from 50 to 100 mass % of the ink solvent.

16. The nonaqueous ballpoint pen as claimed in claim 12, wherein the inner diameter of the ink reservoir tube is from 1.5 to 2.7 mm.

17. The nonaqueous ballpoint pen as claimed in claim 16, wherein the inner diameter of the ink reservoir tube is from 1.6 to 2.6 mm.

* * * * *